United States Patent [19]

Donnelly

[11] Patent Number: 4,730,847

[45] **Date of Patent: * Mar. 15, 1988**

[54] COMPUTER-ASSISTED LABORATORY NOTEBOOK KIT

[75] Inventor: Grace M. Donnelly, Hasbrouck Heights, N.J.

[73] Assignee: General Foods Corporation, White Plains, N.Y.

[ * ] Notice: The portion of the term of this patent subsequent to Nov. 4, 2003 has been disclaimed.

[21] Appl. No.: 886,586

[22] Filed: Jul. 16, 1986

Related U.S. Application Data

[63] Continuation-in-part of Ser. No. 806,891, Dec. 9, 1985, Pat. No. 4,620,726.

[51] Int. Cl.[4] ..... B41L 1/00; B41L 1/20; B65B 15/00; B65B 47/00

[52] U.S. Cl. ..... 282/1 R; 282/11.5 A; 229/69; 53/442

[58] Field of Search ..... 282/1 R, 11.5 A, 11.5 R

[56] References Cited

U.S. PATENT DOCUMENTS

| | | | |
|---|---|---|---|
| 2,350,912 | 6/1944 | Marshall | 53/442 |
| 3,641,732 | 2/1972 | Fujio | 53/442 |
| 3,757,937 | 9/1973 | Weinstein | 53/442 |
| 4,236,731 | 12/1980 | Hektoen | 282/11.5 A |
| 4,300,790 | 11/1981 | Griffin | 282/23 R |
| 4,346,916 | 8/1982 | Shelton | 229/69 |
| 4,448,445 | 5/1984 | Chang | 346/209 |
| 4,620,726 | 11/1986 | Donnelly | 282/11.5 A |

*Primary Examiner*—E. R. Kazenske
*Assistant Examiner*—Paul M. Heyrana, Sr.
*Attorney, Agent, or Firm*—Thomas R. Savoie; Daniel J. Donovan

[57] ABSTRACT

A wrapped packet of papers including a separate title page, one or more separate table of content pages and a continuous strip of fan-folded, two-ply sequentially-numbered paper sheets. Both the separate sheets and the sheets present in the continuous strip possess punched out holes for fastening the sheets into ring or post binders.

6 Claims, 4 Drawing Figures

COMPUTER-ASSISTED LABORATORY NOTEBOOK KIT

This application is a continuation-in-part of my copending U.S. application, Ser. No. 806,891, filed Dec. 9, 1985, now U.S. Pat. No. 4,620,726.

BACKGROUND OF THE INVENTION

It has been routine practice for researchers and inventors working within a technical research organization to record experimental data and results onto the pages of bound laboratory notebooks. Each of these pages is signed, dated and witnessed and is evidence as to when the work was done in any legal proceeding. Typically each notebook within an organization would have its own volume number and each page for recording data within the notebook would have printed thereon both the volume number and its own page number. Usually each page will have printed legends to indicate the desired location for the researcher to write a subject title and/or project number and date, to record data and to sign his name as the person who performed the work. A signature and date line for a witness who has reviewed the recorded data is also provided.

Typically these notebooks are provided with dual pagination such that two adjacent pages are essentially identical with respect to their printed format and page number. The top page of each set of identically numbered pages is intended to be written on directly and to be permanently maintained in the bound volume. The bottom page of each set will receive duplicate information via the use of carbon paper or pressure-sensitive, carbonless copying materials which are coated onto the pages. Various systems for providing for carbonless recording paper are known in the art, as exemplified by U.S. Pat. Nos. 3,016,308 and 3,429,827. These bottom pages are preferably detachable from the bound volume by means of a line of perforations and are suitable for filing in project folders or elsewhere where it would be useful to have a copy of the orginal data available.

It has now become quite common for researchers to utilize personal computers to record, tabulate and/or store information such as experimental data. These researchers have heretofore still been required to write onto laboratory notebook pages information which is stored within the computer and which may already be present on computer printout sheets.

SUMMARY OF THE INVENTION

It is an object of this invention to provide a method whereby information contained within a computer data bank may be printed directly onto paper sheets which will constitute laboratory notebook pages.

It is a further object of this invention to provide a computer-assisted laboratory notebook kit which will permit the construction of a permanent laboratory notebook which includes computer printout sheets, said kit being designed so that research data will be recorded onto paper sheets in an orderly, business-like fashion.

It is a further object of this invention to have such a kit organized in such a manner that there is a high degree of surety that the information printed on the signed and witnessed pages was obtained in a sequential manner and has not been altered.

DESCRIPTION OF THE INVENTION

A computer assisted laboratory notebook kit is assembled by combining within a sealed wrapper, such as a clear plastic shrink wrap casing, a packet of papers which can be inserted into a binder and which will constitute a permanent laboratory notebook record. The package of papers include a plurality of individual sheets, typically $8\frac{1}{2} \times 11$ inches, and a continuous, fan-folded strip of rectangular two-ply recording sheets for feed to a computer printer.

Figure 2:
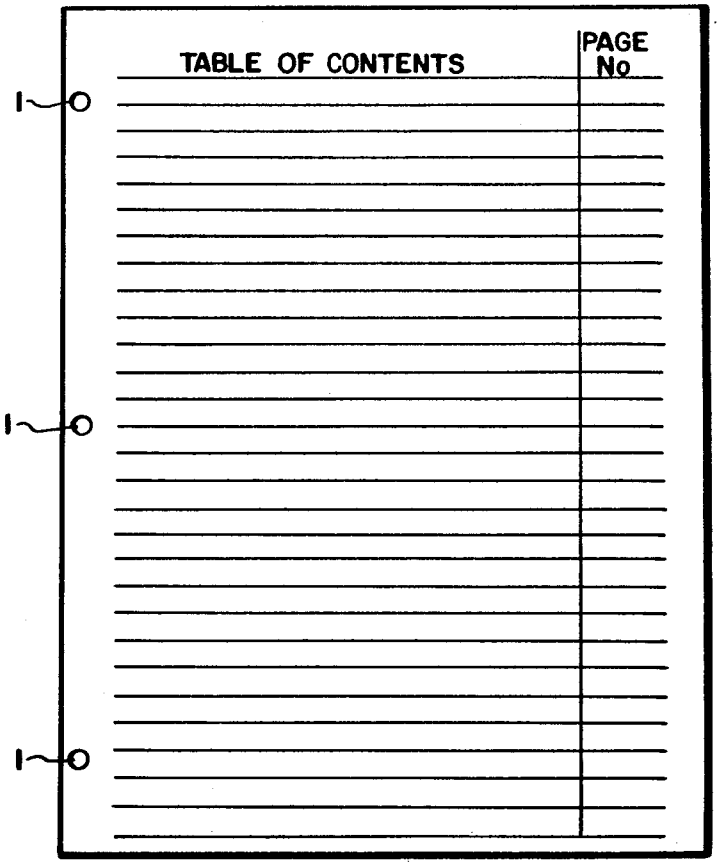
FIG. 2 is a front view of a paper sheet which is suitable as a table of contents page in the kit of the instant invention.
Figure 1:
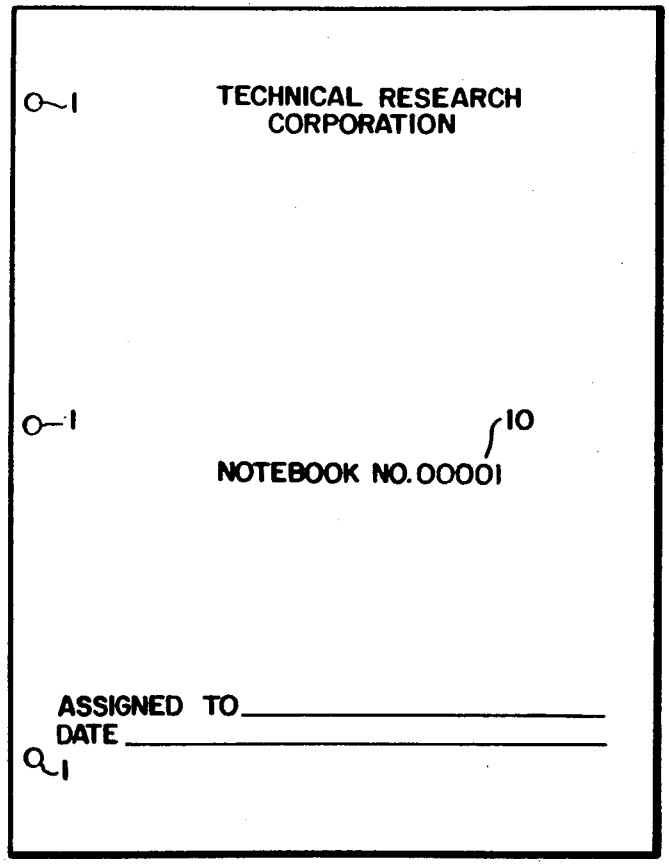
FIG. 1 is a front view of a paper sheet which is suitable as the title page in the kit of the instant invention.
Figure 4:
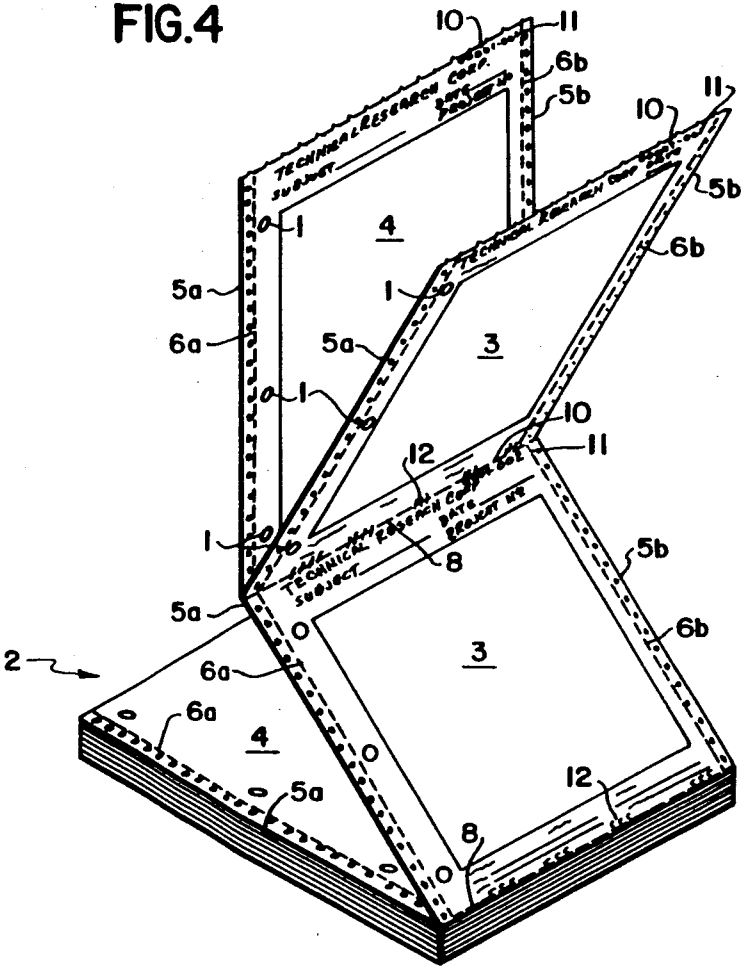
FIG. 4 is a perspective view of a continuous, fan-folded, two-ply set of the computer printout sheets of FIG. 3, which set is suitable for use in the kit of this invention.

The individual sheets contained in the packet will include a single title page sheet, such as shown in FIG. 1, which will have imprinted thereon a unique character designation (e.g. a volume number) which will distinguish each title page from comparable title pages present in other packets. The title page will normally be preprinted with the name of the owner of the notebook and provide lines for entering the name of the employee researcher to whom the book is assigned, the date on which the book is assigned, and possibly the status or location of the researcher. The packet will also include one or more table of content sheets, such as shown in FIG. 2, which may or may not be preprinted with the unique character designation of the title page but which will provide a plurality of preprinted lines for the researcher to enter page numbers and subject headings. The packet may contain additional individual sheets such as instruction sheets and checklist sheets. All of the individual sheets contained within the packet will have aligned, punched out holes 1 in order that these sheets may be incorporated in a ring or post binder. Most typically these pages will have three vertically-spaced holes adjacent the left margin of the sheets for incorporation into a standard three-ring binder.

An appropriately-sized ring or post binder may be included as a component of the kit and may be packaged either within, around or adjacent to the shrink-wrapped packet. When the binder is included as a component of the kit it may be desirable to have the binder preprinted in one or more locations with the same unique character designation found on the title page.

It would be possible to include within the wrapped packet one or more transferable adhesive labels (not shown) which are preprinted with the unique character designation of the title page, these labels being intended for application to a binder. These labels may be affixed to a separate, throw-away transfer sheet which would not need any punched holes or to a free area of one of the individual sheets, preferably the title page. The binder to which the labels are permanently affixed may or may not constitute an element of the kit as sold.

The continuous, fan-folded strip of sheets contained in the packet is a two-ply strip 2 with both top 3 and bottom 4 plys being essentially identical in terms of configuration and printed matter. The sheets will contain suitable coatings or backings such that information recorded or printed on the face of the upper ply will be simultaneously recorded on the face of the bottom ply. Conventional carbonless recording paper coating techniques or carbon paper inserts may be used employed for this purpose.

Both plys of the strip will contain identical and overlying left and right edge perforated tear strips 5a and 5b with each of these strips separable by means of a line of perforations 6a and 6b and also containing a linear array of apertures 7 which serve to interact with the spocket wheels of conventional edge feed computer printers. Both plys of the strip will also possess a plurality of overyling, evenly-spaced, typically 11.5 inch spacing, perforated tear line 8 which are oriented perpendicularly to the edges of the strip and which serve both to assist in the creation of a fan-folded strip and to provide for separation of the two-ply strip into separate two-ply sheets.

The top and bottom plys of the continous strip are adhesively bonded or mechanically notched or crimped together by a series of spaced-apart fastening means which will releasably fasten the top and bottom plys together and which will be located along both left and right tear strips as is well-known to those skilled in the art. In this manner, after the two-ply sheet is separted from the continuous strip and typically after the left and right edge tear strips 5 and 6 are removed, the two plys 3 and 4 freely separate so that the top ply 3 may be inserted into a laboratory notebook binder and the bottom or carbon ply 4 may be placed with a project folder.

Figure 3:
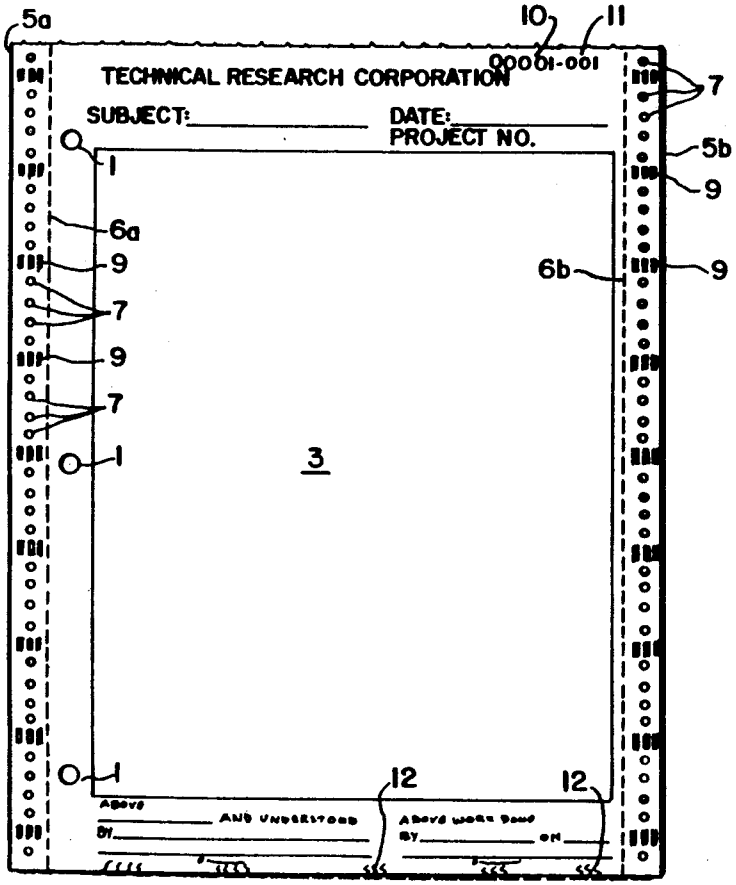
FIG. 3 is a front view of a paper computer printout sheet which is suitable as a notebook page in the kit of the instant invention.

FIG. 3 illustrates a plurality of notched tab sets 9 which releasably fasten top ply 3 to bottom ply 4. According to this embodiment each notched tab set 9 consists of three rectangular perforations which are cut along the bottom and sides such that a punched-out or notched rectangular tab of paper is retained at the top of the perforation. When such perforations are made on overlying sheets the tabs from the top sheet are pushed into the perforation in the bottom sheet and the two sheets become mechanically fastened or crimped together in a releasable fashion.

Each sheet of the two-ply set of sheets contains a plurality of punched-out holes 1 for securing the sheets into the ring or post binder which will also contain the title and table of contents pages from the kit. Each sheet also is preprinted with the character designation 10 present on the title page and also within a sequential page or sheet number 11 begining with number one. Each sheet is also provided with preprinted lines and legends to provide space for identifying the subject, recording experimental data and signing and dating by the researcher and a witness.

As an optional feature a plurality of printed lines or symbols 12 traverse the perforated tear lines 8 which distinguish the strips into separate sheets. These printed lines and symbols, especially if randomly spaced and/or variable between different kits, can serve as a security measure to insure that the numerically adjacent sheets present in the notebook binder were in fact consecutive sheets from the same laboratory notebook kit.

Each set or packet of paper which is to constitute the contents of a permanent laboratory notebook is packaged together within a sealed wrapper (not shown) according to techniques well-known in the packaging arts. The sealed wrapper may be a wrapper, such as Kraft paper, which is sealed closed by means of an adhesive, preferably one which will form a permanent bond between two plys or facings of the wrapping paper. Alternatively, the wrapper may be sealed by means of tapping material and/or lables, preferably in a manner which would include a tamper-evident feature. If the wrapper is opaque appropriate printing or labels must appear on the exterior wrapper surface in order to identify the contents.

The sealed wrapper may also be formed by a clear, plastic film which is shrink-wrapped or heat-sealed around the packet of paper. A polyethylene film may be used for either of these purposes. In the case of a shrink-wrapped package, an oriented plastic film will be employed.

In any of these manners an attractive, tamper-evident package may be distributed to individual technical researchers for use as their personal laboratory notebook. Included within the wrapped package may be one or more support members such as a cardboard or corrugated paperboard sheets.

Having thus described the invention, what is claimed is:

1. A computer-assisted laboratory notebook kit comprised of a wrapped packet of papers for insertion into a binder to form a permanent laboratory notebook said packet including:

(a) a separate title page sheet and at least one separate table of content sheets, said title page sheet being preprinted with a character designation which will distinguish said title page from other comparable title pages, said table of content sheets being designed to permit manual entry of information and said title page sheets and table of content sheets containing aligned punched-out holes for accepting binding posts or rings;

(b) a fan-folded, continuous strip of rectangular, two-ply sets of paper sheets for feed to a computer printer, wherein information printed on the top ply is simultaneously recorded on the face of the bottom ply, and wherein the sheets are distinguished by perforated tear lines perpendicular to the edges of the strip, said tear lines providing for separation of the continuous strips into separate sets of paper sheets, said strips containing left and right edge perforated tear strips with each of said tear strips containing a linear array of apertures designed to permit engagement with sprocket wheels of edge feed computer printers, each sheet being preprinted with the character designation present on the title page and a sequential sheet number, said sheet numbers begining with numeral one, and wherein both plys of each set of paper sheets possess identical sheet numbers and further each sheet containing punched-out holes aligned with the holes present in the title page; and (c) a sealed wrapper surrounding said packet of papers.

2. The kit of claim 1 wherein the set of papers includes a transferable adhesive label, said label being preprinted with the character designation of the title page and said label being designed to be affixed to a binder.

3. The kit of claim 1 wherein a thin layer of microscopic capsules containing a suitable marking substance is bonded to the back of the top ply of each set of sheets.

4. The kit of claim 1 wherein a carbon paper backing is affixed to the back of the top ply of each set of sheets.

5. The kit of claim 1 wherein a plurality of printed lines or symbols traverse the perforated tear lines which distinguish the sheets.

6. The kit of claim 1 which further includes a ring or post binder to accept said sheets.

* * * * *